United States Patent [19]

Belsanti

[11] Patent Number: 4,653,441

[45] Date of Patent: Mar. 31, 1987

[54] ENGINE ROCKER ARM ASSEMBLY

[75] Inventor: James F. Belsanti, Blue Island, Ill.

[73] Assignee: Navistar International Corporation, Chicago, Ill.

[21] Appl. No.: 855,015

[22] Filed: Apr. 22, 1986

[51] Int. Cl.[4] ..... F01L 1/18

[52] U.S. Cl. ..... 123/90.39; 123/90.42; 74/519

[58] Field of Search ..... 123/90.39, 90.41, 90.42; 74/519, 559; 29/156.4 R

[56] References Cited

U.S. PATENT DOCUMENTS

| | | | |
|---|---|---|---|
| 2,572,968 | 10/1951 | Bachle | 123/90.41 |
| 3,198,183 | 8/1965 | Ball | 74/519 |
| 3,270,727 | 9/1966 | Nance | 74/519 |
| 3,274,983 | 9/1966 | Herring | 74/519 |
| 3,401,678 | 9/1968 | Rose | 74/519 |
| 3,407,792 | 10/1968 | Buchwald | 74/519 |
| 3,614,943 | 10/1971 | Schley | 123/90.42 |
| 3,870,024 | 3/1975 | Ridgeway | 123/90.41 |

*Primary Examiner*—Ira S. Lazarus

*Attorney, Agent, or Firm*—F. David Aubuchon; Dennis K. Sullivan

[57] ABSTRACT

A retainer is installed on the pedestals of adjacent rocker arm assemblies to tie the pedestals, rocker arms, and retainer into a permanent subassembly. The retainer includes rectangular apertures for receiving the pedestal shanks which in one direction comprise spring steel tabs which grip the sides of the pedestal shank with high unit loading and in the other direction provide generous clearance to permit axial sliding adjustments of the pedestals relative to each other to align the bolt holes and thus facilitate installation of the subassembly on the engine head. The spring steel tabs further align the pedestals with each other and with the engine and prevent the pedestals from turning when the tie down bolts therethrough is torqued.

8 Claims, 3 Drawing Figures

ENGINE ROCKER ARM ASSEMBLY

BACKGROUND OF THE INVENTION

This invention relates to pedestal mounted rocker arms of the type used in internal combustion engine valve trains and, more particularly, to a means for preventing lateral pivoting movement of the rocker arms out of the plane of reciprocal movement while maintaining the rocker arms and support means as an assembly prior to their installation on the engine.

THE PRIOR ART

It is previously known from Schley U.S. Pat. No. 3,614,943 to provide a rocker arm assembly wherein the rocker arm has a cylindrical bottom surface which mates with a cylindrical surface of a pedestal support. The pedestal support shank is flat sided and extends through a flat sided opening in the rocker arm surface to prevent relative rotation therebetween and fits in a trough laying on the cylinder head. When two adjacent rocker assemblies are bolted down with their pedestals in the trough, both pedestals are prevented from rotating relative to each other, as well as to the engine, thereby preventing the rocker arm from laterally pivoting out of its plane of reciprocation. However, during manufacture or rebuilding of the engine, the various pieces of the Schley assembly must be assembled in place on the cylinder head since the trough is not attached to the pedestal. This is inconvenient and, in the case of an engine rebuild, does not ensure that the rebuild is done with new parts or that mating parts are reassembled together.

SUMMARY OF THE INVENTION

In accordance with the present invention, a novel retainer is installed on the pedestals of adjacent rocker arms to tie the pedestals, rocker arms, and retainer into a permanent subassembly. The retainer includes rectangular apertures for receiving the pedestal shanks which in one direction comprise spring steel tabs which grip the sides of the pedestal shank with high unit loading and in the other direction provide generous clearance to permit axial sliding adjustments of the pedestals relative to each other to align the bolt holes and thus facilitate installation of the subassembly on the engine head. The spring steel tabs further align the pedestals with each other and with the engine and prevent the pedestals from turning when the tie down bolts therethrough is torqued. Thus, the two rocker arm assemblies for each cylinder can be subassembled as an operating unit prior to engine assembly; indeed, if desired, all of the rocker arms for all cylinders in one bank of an engine can be preassembled before installation on the engine. Moreover, when the rocker arm subassembly is furnished for service, the purchaser can be more assured that he is receiving an assembly entirely of new parts properly assembled. Mixing old and new parts, especially an old rocker arm on a new pedestal would increase the possibility of premature wear of the bearing surfaces.

Accordingly, it is an object of the invention described and claimed herein to provide a pedestal type rocker arm assembly for an internal combustion engine in which a retainer maintains the pedestals and rocker arms of individual adjacent rocker arm assemblies in alignment with each other and with the engine, even if the rocker arm assembly is disassembled and reassembled on the engine.

A further object of the invention is to provide a permanent subassembly of a plurality of rocker arm assemblies.

Yet another object of the invention is to provide a permanent rocker arm subassembly of a plurality of individual rocker arms wherein the individual rocker arm assemblies can be relatively axially adjusted to fit the engine.

Other objects and advantages of the invention will become more apparent upon reading the detailed description thereof and upon reference to the drawings in which.

DETAILED DESCRIPTION OF THE PREFERRED EMBODIMENT

Figure 2:
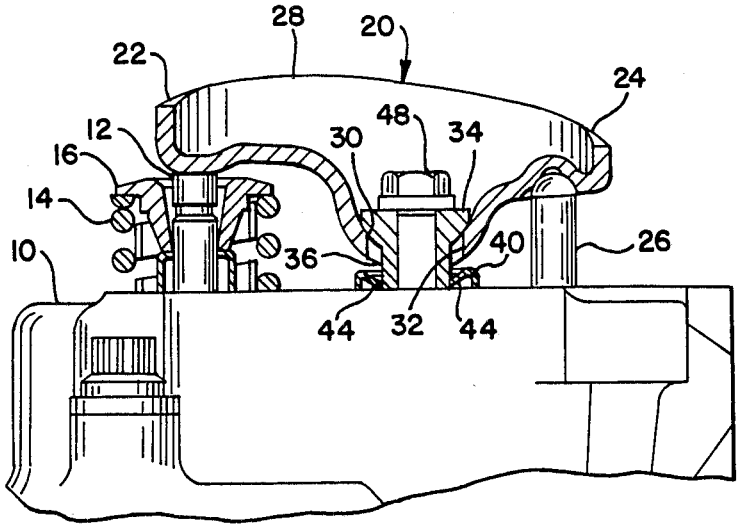
FIG. 2 is a sectional view in the plane of reciprocation of a rocker arm assembly of FIG. 1 mounted on the unsectioned cylinder head and taken along the line 2—2 of FIG. 1.

Referring now to the drawings, there is shown a cylinder head assembly generally designated 10 which might enclose one cylinder bank of a V-8 configuration internal combustion engine. As best seen in FIG. 2, various elements of the engine valve train are mounted on the cylinder head and including a poppet valve stem 12 biased upwardly to a closed position by valve spring 14 acting on spring retainer 16 attached to the valve stem 12. Rocker arm assembly 20 pivotally mounted to the head 10 has one end 22 in contact with the top of valve stem 12 and the other end 24 contacted by push rod 26, the other end of the push rod being in contact with a cam follower (not shown) controlled by a camshaft (not shown) as is conventional. Thus, vertical reciprocating movements of the pushrod 26 against the rocker assembly 20 cause pivotal reciprocation of the rocker arm assembly to open and close valve 12.

The rocker arm assembly 20 comprises a rocker lever 28 having a semicylindrical concave bottom bearing surface 30 disposed transverse of the length of the rocker arm between the ends 22 and 24 thereof. The semicylindrical surface 30 is further provided with a partially circumferential slot 32 extending therethrough, the sides thereof in the axial direction being flat and perpendicular to the pivot axis. A pedestal 34 has a semicylindrical downwardly facing bearing surface which slidingly mates with the semicylindrical bottom surface 30 of the rocker lever 28. The pedestal 34 further has a square shank portion 36 which depends downwardly from the semicylindrical surface and extends through the slot 32 in the rocker lever 28. The clearance of the slot 32 of the rocker shank relative to the axial sides of the pedestal shank 36 is relatively small and thus the rocker lever is prevented from lateral pivoting movements relative to the pedestal 34.

A retainer 40, which is a spring steel stamping, has a plurality of apertures 42, each of which receives the shank portion 36 of a pedestal 34, which are disposed to locate the pedestals and thus the rocker levers 28 in aligned position with the valve stem 12 and push rod 26.

Figure 3:
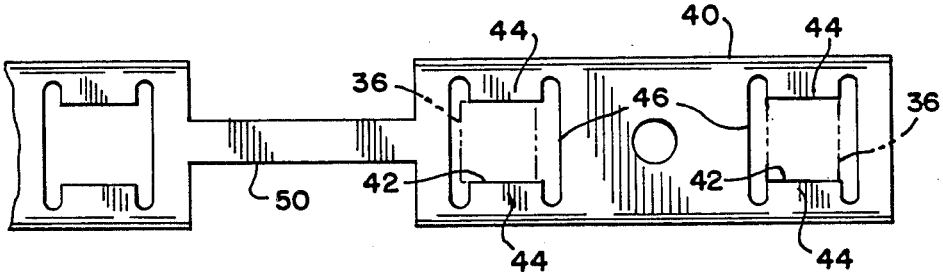
FIG. 3 is a plan view of a portion of the retainer which is part of the rocker arm assembly illustrated in FIG. 2.

The retainer 40 comprises opposed spring biased tabs 44 having their edges defining sides of apertures 42 disposed perpendicular to the axis of pivoting and are spaced a smaller distance than the width of the sides of the shank portion 36 of the pedestal 34. Thus, when the pedestal (including the rocker lever 28) is pushed through the retainer 40, as illustrated in FIG. 2 and in phantom lines in FIG. 3, the spring tabs 44 deflect downwardly and create a high unit pressure against the shank portion 36 and thus bind the retainer 40, pedestal 34 and rocker 28 as a permanent subassembly. The sides of the apertures 42 in the axial direction are disposed to provide a generous amount of clearance with the axial sides of the shank 36 so that the shanks 36 may be slid axially along the rotational axis even though the tabs 44 prevent withdrawal to assist the installation of the subassembly of a plurality of rocker arms 20 on the engine. A bolt 48 extends through the center of the pedestal 34 and thus ties each rocker arm assembly 20 down to the cylinder head 10. It can be seen that when pedestals 34 are inserted in both apertures 42 of the retainer 40, the relative positions of the pedestals become fixed relative relative to each other and, when the bolts 48 are inserted through both pedestals 34, the pedestals become fixed and aligned relative to the engine and thus lateral pivoting movements of the rocker arms out of the plane of reciprocation, which could disengage or adversely load the valve stem or push rod, is prevented.

Figure 1:
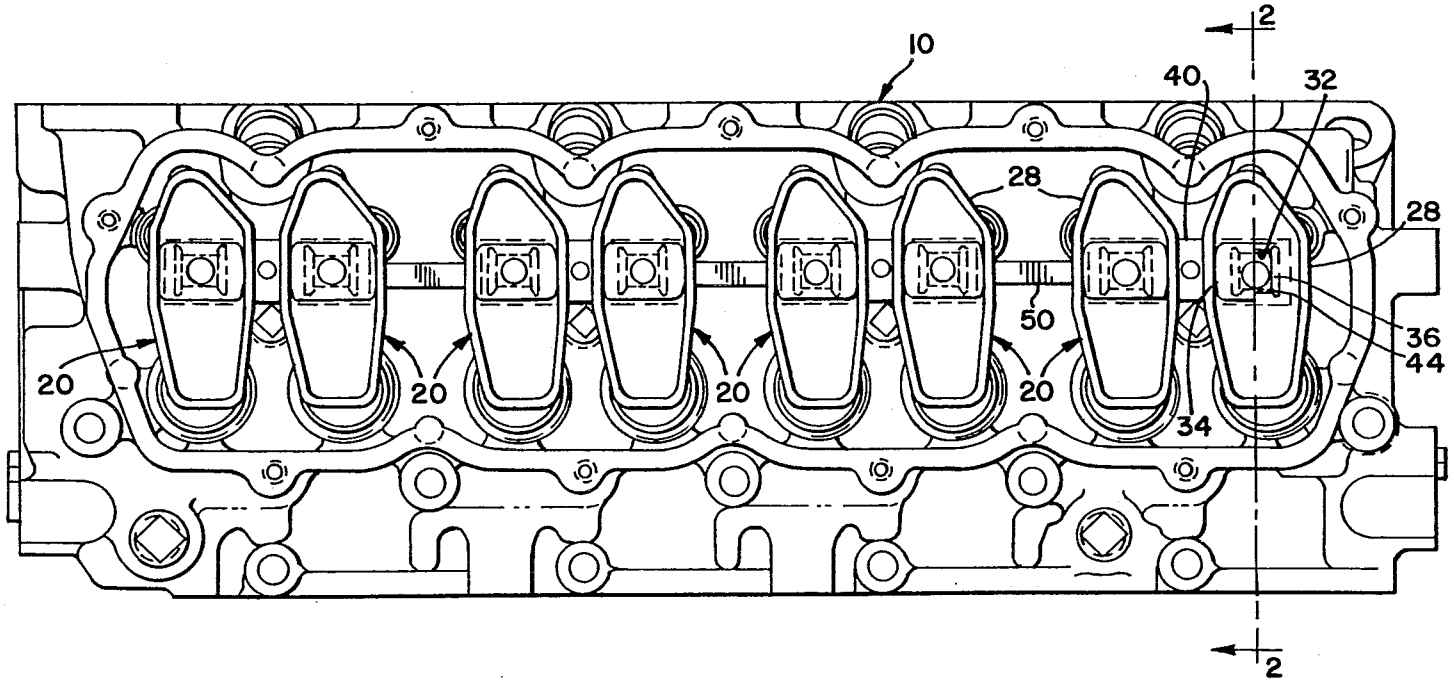
FIG. 1 is a partially cut-away plan view of a engine cylinder head having a plurality of individual rocker arm assemblies incorporating the present invention installed thereon.

As shown in FIG. 1, the retainer 40 is designed to capture the pedestals of adjacent rocker assemblies of the same cylinder of the engine. However, a narrow tab 50 can be disposed between the retainers of adjacent cylinders and thus form a single retainer extending across all cylinders of an entire bank of the engine. Thus all of the rocker arm assemblies 20 of that bank can be tied together in a single subassembly for manufacturing purposes. In this connection, the above-mentioned axial adjustment feature is magnified. Yet the narrow strips 50 can be cut to provide replacement of the rocker arm assemblies for just one cylinder for service.

Thus, there has been described, in accordance with the invention, a rocker arm assembly which fully meets the objects, aims and advantages set forth above. Although a single embodiment of the invention has been described, it will become apparent to those of ordinary skill in the art that other modifications and alterations may be made to the design without departing from the scope of the appended claims.

What is claimed is:

1. A rocker arm assembly of a plurality of pedestal-mounted rocker arms adapted to be supported on an engine comprising:

a plurality of rocker arms, each having a bottom concave semicylindrical bearing surface having a flat-sided opening therein;

a plurality of fulcrum support means respectively associated with each rocker arm, each support means having a semicylindrical body portion having a lower bearing surface slidably mating with said rocker arm bottom surface to form a pivot axis and having a flat-sided shank portion projecting downwardly from said lower bearing surface, through the opening in said rocker arm surface in relative rotation preventing relation therewith, to a distal end adapted to engage an engine mounting surface; and a retainer means having a plurality of apertures respectively associated with each of said rocker arms, each aperture receiving and nonremovably engaging said flat sides of said shank portion of said fulcrum support means in relative rotation preventing relation therewith such that a permanent assembly of said plurality of rocker arms, fulcrum support means, and retainer means is formed.

2. The invention in accordance with claim 1 and said retainer means comprising a spring steel strip, a dimension of said apertures being sufficiently smaller than that of said fulcrum support means shank portion such that a spring biased grip of said shank portion is obtained.

3. The invention in accordance with claim 2 wherein the axial dimension of said apertures in said retainer means is sufficiently larger than that of said shank portion of said fulcrum support means to permit axial adjustment of said individual rocker arm and fulcrum support means therein while maintaining said plurality of rocker arms, fulcrum support means, and retainer means as an assembly.

4. A rocker arm assembly for a plurality of pedestal mounted rocker arms adapted to be mounted on an engine comprising:

a plurality of rocker arms, each having a semicylindrical bottom fulcrum bearing surface having an opening therein, the axial sides of said opening being parallel and flat;

a plurality of fulcrums respectively associated with each rocker arm, each fulcrum having a semicylindrical body portion slidably mating with said rocker arm bearing surface and a rectangular shank portion projecting downwardly through said rocker arm opening in relative rotation preventing relation therewith to a distal end adapted to engage an engine mounting surface; and a retainer having a plurality of apertures for receiving said rectangular shank portions of said pedestals in a relative rotation preventing relation therewith, opposite sides of said apertures comprising a pair of opposed tabs having edges spaced less than the thickness of said shank disposed to deflect upon said shank portion being pushed through said aperture, said tabs being biased to grippingly engage the sides of said shank portion of said fulcrum in a manner preventing withdrawal of said shank portions from said retainer.

5. The invention in accordance with claim 4 and the edges of said tabs being disposed perpendicular to the plane of pivoting of said rocker arms, and the length of said aperture in the axial direction being substantially larger than the size of said shank portion to permit axial adjustments of said fulcrums while maintaining said rocker arm, fulcrum, and retainer as an assembly.

6. The invention in accordance with claim 4 said retainer comprising a spring steel stamping.

7. The invention in accordance with claim 4 and said plurality of rocker arms comprising all of the rocker arms associated with all adjacent cylinders in an engine.

8. The invention in accordance with claim 4 and said plurality of rocker arms comprising all rocker arms in one bank of a V-type engine.

* * * * *